US005419446A

United States Patent [19]

Cox et al.

[11] Patent Number: 5,419,446

[45] Date of Patent: May 30, 1995

[54] NON-REFILLABLE CONTAINER CLOSURE

[75] Inventors: Malcolm A. Cox, Sutton Coldfield; Matthew J. Lloyd, Wednesbury, both of United Kingdom

[73] Assignee: MCG Closures Limited, United Kingdom

[21] Appl. No.: 32,631

[22] Filed: Mar. 17, 1993

[30] Foreign Application Priority Data

Mar. 26, 1992 [GB] United Kingdom ..... 9206602

[51] Int. Cl.[6] ..... B65D 49/02

[52] U.S. Cl. ..... 215/21; 220/374

[58] Field of Search ..... 215/18, 21; 220/374

[56] References Cited

U.S. PATENT DOCUMENTS

| | | | |
|---|---|---|---|
| 833,134 | 10/1906 | Jackson | 215/21 |
| 899,214 | 9/1908 | Gafney | 215/21 |
| 920,771 | 5/1909 | Melisch | 215/21 |
| 934,659 | 9/1909 | Daniel | 215/21 |
| 1,098,988 | 6/1914 | Smith | 215/21 |
| 2,078,251 | 4/1937 | Jesnig . | |
| 2,199,323 | 4/1940 | Spanyer | 215/21 |
| 3,063,589 | 11/1962 | Musel | 215/21 |
| 3,084,822 | 4/1963 | Guala | 215/21 |
| 4,258,854 | 3/1981 | Wright | 215/21 |
| 4,497,415 | 2/1985 | Delonghi | 215/21 |

FOREIGN PATENT DOCUMENTS

| | | | |
|---|---|---|---|
| 467752 | 1/1914 | France . | |
| 486835 | 6/1938 | United Kingdom | 215/21 |
| 835507 | 5/1960 | United Kingdom . | |
| 1002513 | 8/1965 | United Kingdom . | |
| 2088317 | 11/1981 | United Kingdom . | |

*Primary Examiner*—Allan N. Shoap
*Assistant Examiner*—Christopher J. McDonald
*Attorney, Agent, or Firm*—Laubscher & Laubscher

[57] ABSTRACT

The invention provides an anti-glug fitting for co-operation with the neck portion of a container for liquids, the fitting comprising an outer body adapted to conform to the neck of the container, and formed with a shaped through bore extending from an inlet end to an outlet end and a guard member partially obturating the outlet; wherein the outlet opens from a chamber defined by the through bore and by opposed spaced apart faces of the guard member and a fixed or movable member, and by a plurality of apertures forming part of the through bore which allow fluid flow past the valve body. The total area defined by the apertures is equal to, or less than, the total area of the outlet, thereby to alleviate glugging by providing that air may pass into the neck of the container at a rate equal to, or greater than, the rate at which liquid flows out. The fixed or movable member is preferably a moveable valve body which co-operates at its periphery with a plurality of radially spaced apertures forming a part of an inlet passage in the open position, but obturated in the closed position by the valve body seating on the valve seat.

11 Claims, 5 Drawing Sheets

NON-REFILLABLE CONTAINER CLOSURE

BRIEF DESCRIPTION OF THE PRIOR ART

The present invention relates to non-refillable closures for containers and particularly for containers containing valuable commodities such as alcoholic beverages.

It is an ongoing problem to prevent the unauthorized addition of adulterating liquids such as water to bottles containing high value alcoholic liquids such as whisky, gin, or vodka.

Attempts have been previously made over the years to address this problem in, for example, GB-A-835507 and GB-A-1002513. GB-A-835507 provides a non-refillable fitting for co-operation with the neck portion of a container for liquids, the fitting comprising an outer body adapted to conform to the neck of the container, and formed with a shaped through bore provided toward an inlet end with a valve seat and toward a remote end with an outlet; a valve member slidingly co-operable in the bore between a closed position in abutment with the valve seat and an open position, and a guard member partially obturating the outlet. The valve body is provided with a plurality of radially disposed fins over a portion of the length thereof.

It will be appreciated that when the bottle with the fitting attached thereto is reversed to release the liquid contents therefrom the valve moves from the seat and allows the liquid to flow past the finned valve body over the guard member and through the outlet. When the container is returned to its upright position the valve body falls back onto the seat, thereby preventing any adulterating liquid from entering via the outlet.

Unfortunately it is, in practice, relatively easy to circumvent this arrangement.

Similarly, GB-A-1002513 provides an arrangement wherein the valve body is provided with a spherical surface for contact with the valve seat. Again it is possible to adulterate liquids in the bottle.

SUMMARY OF THE INVENTION

Accordingly, one aspect of the invention seeks to alleviate the problem of unauthorized addition of adulterating liquid to a container, while at the same time providing a serpentine outlet passage without impeding significantly the dispensing operation. Accordingly the present invention is characterized in that the outlet has a radial component and in that the outlet opens from a chamber defined in the open position by opposed spaced apart faces of the valve member and the guard member; the chamber exceeding in depth the depth of the outlet passage therefrom.

A further problem which has not been addressed in the prior art is the problem of how to alleviate glugging in fittings such as this, while optionally retaining the non-refillable facility above described.

Glugging is the phenomenon which occurs when the volume of liquid flowing from a bottle, or other container, is not replaced by a gas such as air in the container itself. It is therefore necessary for air to force an entry into the container via the container neck to equalize the negative pressure induced by the passage of liquid from the container.

We have now found that glugging is at least alleviated if the total inlet air area defined by the valve member is the determinant of the volume of liquid dispensed.

Put another way air must pass into the container neck at a rate equal to, or greater than, the flow of liquid out.

According to another aspect of the invention there is provided an anti-glug fitting for cooperation with the neck portion of a container for liquids, the fitting comprising an outer body adapted to conform to the neck of the container, and formed with a shaped through bore extending from an inlet end to an outlet end and a guard member partially obturating the outlet. The fitting is characterized in that the outlet opens from a chamber defined by the through bore and by opposed spaced apart faces of the guard member and a fixed or movable member, and by a plurality of apertures forming part of the through bore which allow fluid flow past the valve body. The total area defined by the apertures is equal to, or less than, the total area of the outlet, thereby to alleviate glugging by allowing air to pass into the neck of the container at a rate equal to, or greater than, the rate at which liquid flows out.

In a preferred form of this aspect of the invention, the anti-glug facilities are combined with at least some features of the non-refillable fitting. In such an arrangement, the fixed or movable member is a movable valve body and the outlet opens from a chamber defined in the open position of the valve body by opposed spaced apart faces of the valve member and the guard member respectively. The valve body co-operates at its periphery with a plurality of radially spaced apertures forming a part of an inlet passage in the open position, but obturated in the closed position by the valve body seating on the valve.

In a preferred form of the invention the outlet has a second directional component generally perpendicular to the radial component. Preferably the face of the valve member is spaced from the radial inlet to provide an enlarged chamber having a depth which substantially exceeds the depth of the outlet passage.

It is preferred that the outlet passage flowing past the valve body to the exterior has at least three changes in direction, each generally of the order of 90°. By "generally of the order of" is meant an angular displacement of ±20°.

In a preferred form of the invention of the latter type, the first and third directions are generally parallel as, in another embodiment, are the second and fourth directions.

In a particularly preferred form of the invention of this last type, the height of the outlet (a), the distance Co) between the upper surface of the valve body in its open position and the lower edge of the outlet (a); the width (c) of the outlet channel, the length (d) of the outlet channel and the width (e) of the horizontal passage, conform to the requirement that:

(a) is less than Co) and no more than 1.5 ×(e)

(c) is up to 1.5 ×(a)

and (d) is at least 2 ×(a).

In another preferred form of the invention the total volume of the chamber is adapted to exceed the volume of the apertures in the valve body whereby the flow of liquid in the open position is defined by the total area of the apertures. It will be appreciated that by arrangements of this sort it is possible to provide both alleviation of the glugging problem and an increase in security against unauthorized adulteration of the contents of the container.

Preferably the apertures in the valve body are formed by a plurality of fins located in a spaced array about the periphery of the valve body. The fins may be parallel either to the axis of the valve body or to each other and angled to the axis of the valve body. Preferably in each case the fin has a trapezoidal shape. In such circumstances it is most preferred that the valve body has a frusto-conical portion adapted for co-operation with the valve seat.

In the most preferred form of the invention the fitting is formed of three main elements; an outer body, a guard member and a valve member, wherein the guard member has an internal radial dimension which is smaller than the external radius of the valve member thereby to form the chamber in the open position.

In British Patent No. GB-A-1596984 there is claimed a combined non-refillable/pilfer proof closure assembly for a bottle comprising a tubular molded plastics body having an outer diameter not greater than the external diameter, but greater than the internal diameter, of the bottle neck adjacent to the mouth of the bottle, the body having an external thread toward the upper or mouth end thereof, the body housing a non-refillable fitment which has a cylindrical portion extending beyond the lower end of the tubular body, a gasket gripping the cylindrical portion and extending radially outwardly to underlie the bottom end of the tubular body and having a plug portion adapted to fit into and seal against the internal diameter of the bottle neck, the tubular body being located within an outer metal shell having a crown, an upper skirt portion connected to a lower security band portion by a series of angularly-spaced bridges located in an interrupted slit line, at least the lower portion of the security band having a diameter slightly in excess of the external diameter of the container neck, the upper skirt portion of the metal shell being provided with a threaded plastics insert for co-operation with the external thread, whereby the assembly may be conjoined by threaded interengagement and applied to the container neck by axial pressure upon the shell.

Whereas this arrangement is entirely satisfactory, it requires that the outer metal shell is rolled, by known processes, into engagement with the fitting and the bottle top. It will be appreciated that this rolling step can be complex in that it requires a number of external threads to be rolled onto the metal cap and security band portion while the fitting is held in axial compression against the neck of the container. Whereas this can be satisfactorily effected, the present arrangement becomes problematical if it is desired to sell the fitting to manufacturing entities which do not have the comparatively complex bottle top thread rolling apparatus.

Accordingly, therefore, a further aspect of the invention is characterized in that the step of interengaging the security band to the shoulder or groove on the container neck by rolling is effected after, or simultaneously with, the step of rolling a formation onto the security band to inter-engage with the corresponding formation on the tubular body to retain the upper skirt portion in situ until first use.

In a preferred form of arrangements of this type the external thread is displaced relatively radially inwardly whereby the shell has an outer diameter the same as, or marginally larger, than that of the neck of the bottle to which it is applied.

The shell may be inter-fitted with the tubular body and the container neck by a rolling step wherein the body requires essentially a single annular recess inferior to the line of bridges to engage a formation whereby the rolling of the security band and the other formation acts to lock the fitting about the container neck.

In arrangements of this sort, the threaded plastics insert can also be extended to provide a liner to the inner surface of the crown of the metal shell.

BRIEF DESCRIPTION OF THE DRAWINGS

The invention will now be described, by way of illustration only, with reference to the accompanying drawings wherein.

DETAILED DESCRIPTION

Figure 1:
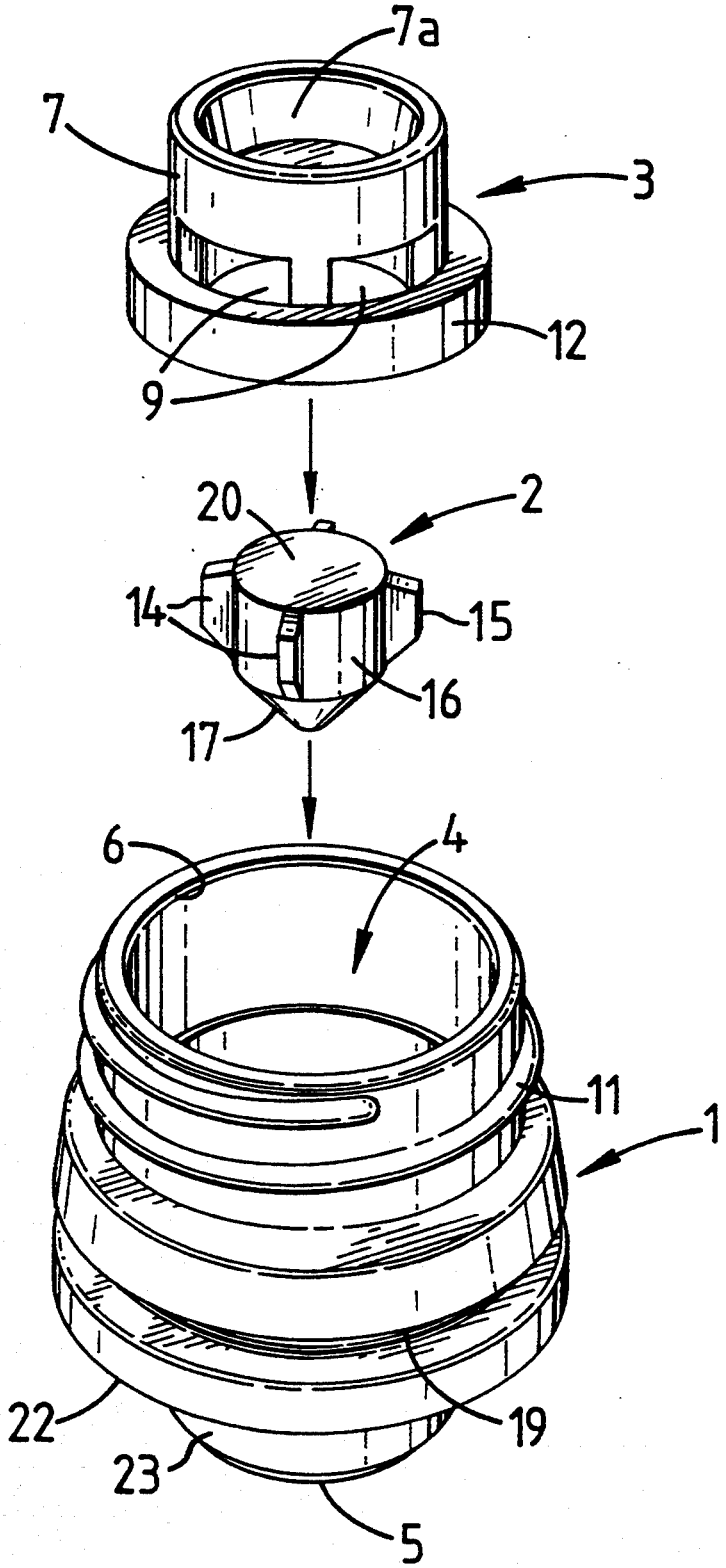
FIG. 1 shows an exploded view of the components of a first fitting in accordance with the present invention.

With reference first to FIG. 1, outer fitting body (1) is formed with a shaped through bore (4) extending from an outlet end (6) to an inlet end (5). The exterior of the body (1), which is formed in this instance of a clear polystyrene, is formed with an external screw thread (11) adjacent the outlet end of the fitting. The body (1) is also formed with an annular recess (19) for interengagement with a metal shell. The body (1) terminates towards its lower end in a container neck plug (23), the surface of which is a sliding fit into a container neck. Outer body flange (22) is adapted to overlay the end of the neck in use.

A valve member (2) is provided with a substantially cylindrical body (16), terminating towards its lower end in a frusto-conical portion (17) which is adapted for co-operation with a valve seat (18) at the inlet end (5) of the body (1). Disposed regularly about the periphery of the valve body (16) are four radially disposed trapezoidal fins (14). These fins are shown disposed perpendicular to the axis (A) of the valve body (16), but they may be helically arranged if it is desired to cause the body (16) to spin in use. The upper surface of the valve body (20) forms the floor of a chamber which will be described later. The trapezoidal fins (14) are angled in such a way that the outer faces (15) are in free sliding contact with a portion of the shaped bore (4).

The guard member (3) has a generally top-hat configuration and is provided with an outwardly directed flange (12) which is adapted to interfit in the shaped bore (4). The guard member (3) is also provided with radial outlet channels (9) disposed through an upstanding annular guard member (7). The guard member (7) is formed with a recess *(7a)* to render it more difficult to insert implements into the fitting.

Figure 2:
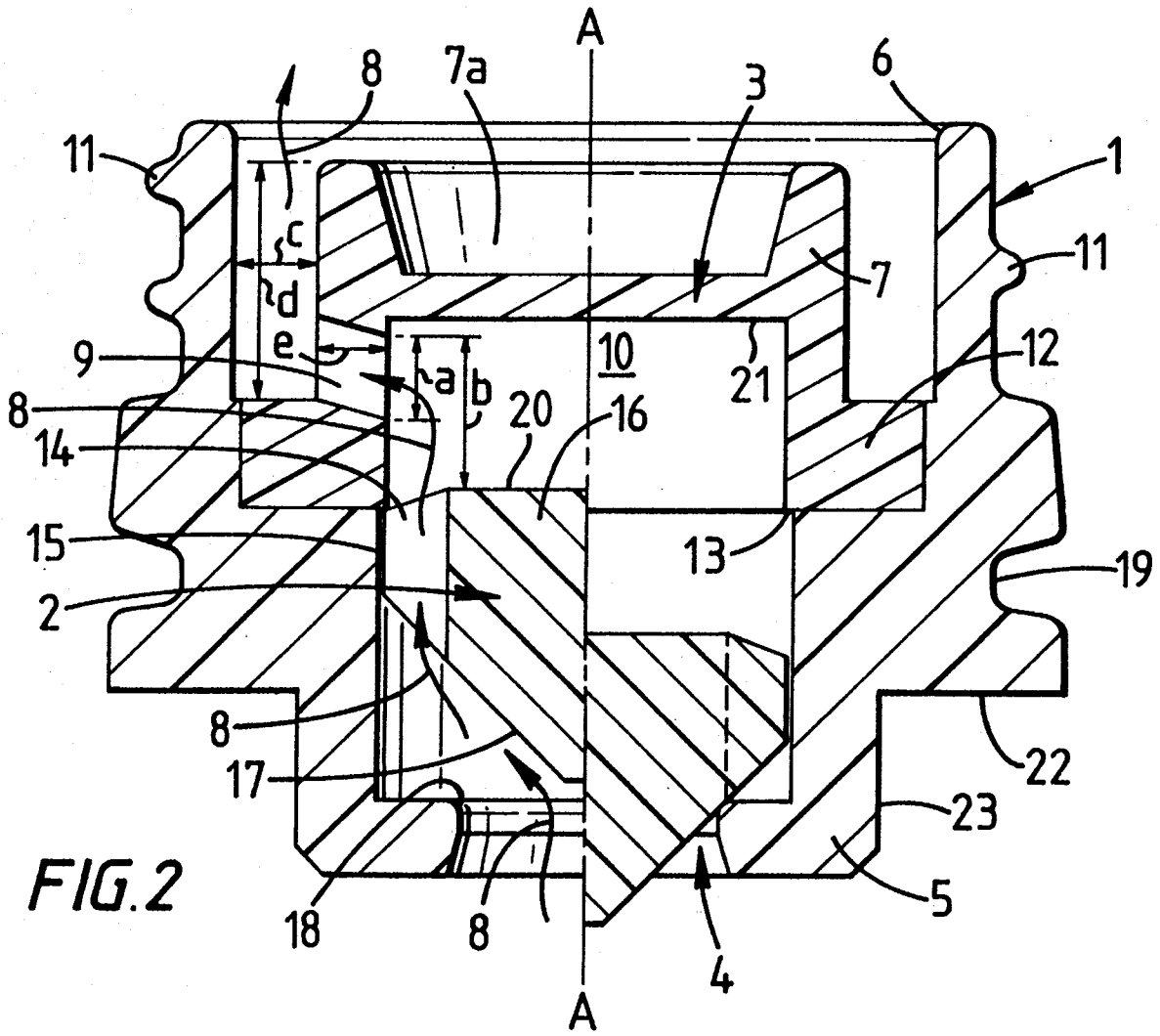
FIG. 2 shows a vertical cross-section of the fitting of FIG. 1 in full inter-engagement and in the open and closed positions.

Turning now to the arrangement of FIG. 2, it will be noted that the outlet end (6) represents the terminal portion of the outlet passage shown generally at (8), preferably having certain defined parameters (a) to (e).

It will be noted that the flange (12) interfits in the shaped through bore (4) at the foot of the outlet passage (8) so as to provide a serpentine access passage to the valve body (16). The underside of the guard member (3) is formed by a lower surface of the guard member (21). This is juxtaposed to the upper surface of the valve body (20). It will be noted that the internal diameter of the guard member (3) is slightly less than the adjacent portion of the shaped through bore (4) and accordingly provides an annular stop (13). It will be also noted that the outer diameter of the fins (14) exceeds the diameter of the annular stop (13) whereby the valve body (16) is prevented from moving into the so-formed chamber (10) by more than is shown to the left-hand side of the diagram of FIG. 2.

It will thus be appreciated that the volume of air disposed in the device, both in the chamber (10) and flowing through the radial outlet channels (9), is considerably in excess of the volume of the apertures defined by the fins (14) and the valve body (16). This means that air is always available in excess to the contents of the container whereby glugging is alleviated.

Further, because the valve body (16) cannot reach the aperture (9), it is very difficult to introduce even a resilient member to retain the valve body in a position other than that which was intended. This is especially so if the measurements given hereinbefore for (a), (b), (c), (d) and (e) are adhered to because it is then difficult to fashion a wire element, for example, which will both fit into the passage (8), enter the radial passage (9) and be able to interfere with the valve body (16) by interposing itself between fins (14).

Accordingly, by utilization of the chamber (10) it is possible both to alleviate the problem of glugging and to very much assist prevention of unwarranted adulteration.

The valve body (16) is formed with a frusto-conical portion (17) which is adapted for co-operation with a valve seat (18) adjacent the inlet end (5). It will be appreciated that slight misalignments of the valve body (16) relative to the outer body and the valve seat (18) can be taken up because of the frusto-conical nature of the valve body.

Figure 4:
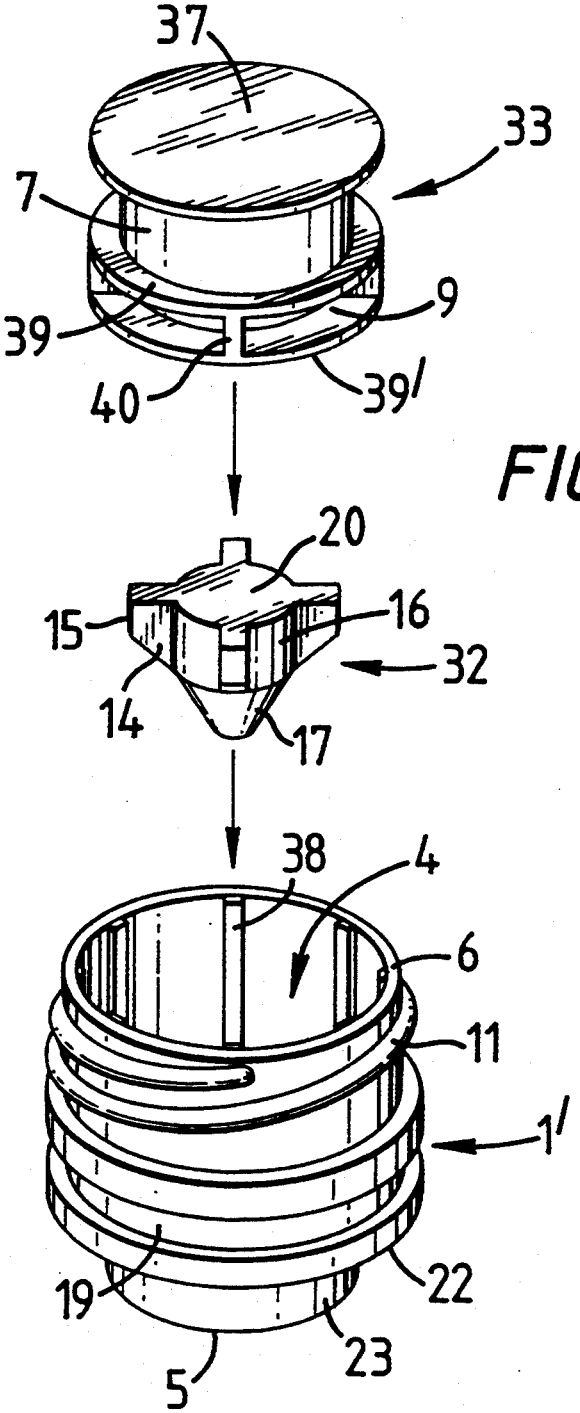
FIG. 4 shows an exploded view of components of a second fitting in accordance with the present invention.
Figure 5:
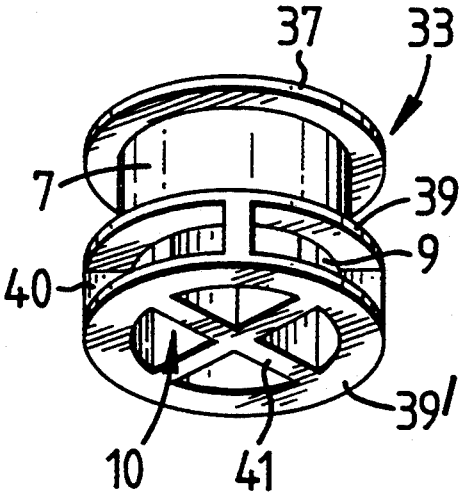
FIG. 5 shows an alternative view of the guard member of FIG. 4.
Figure 6:
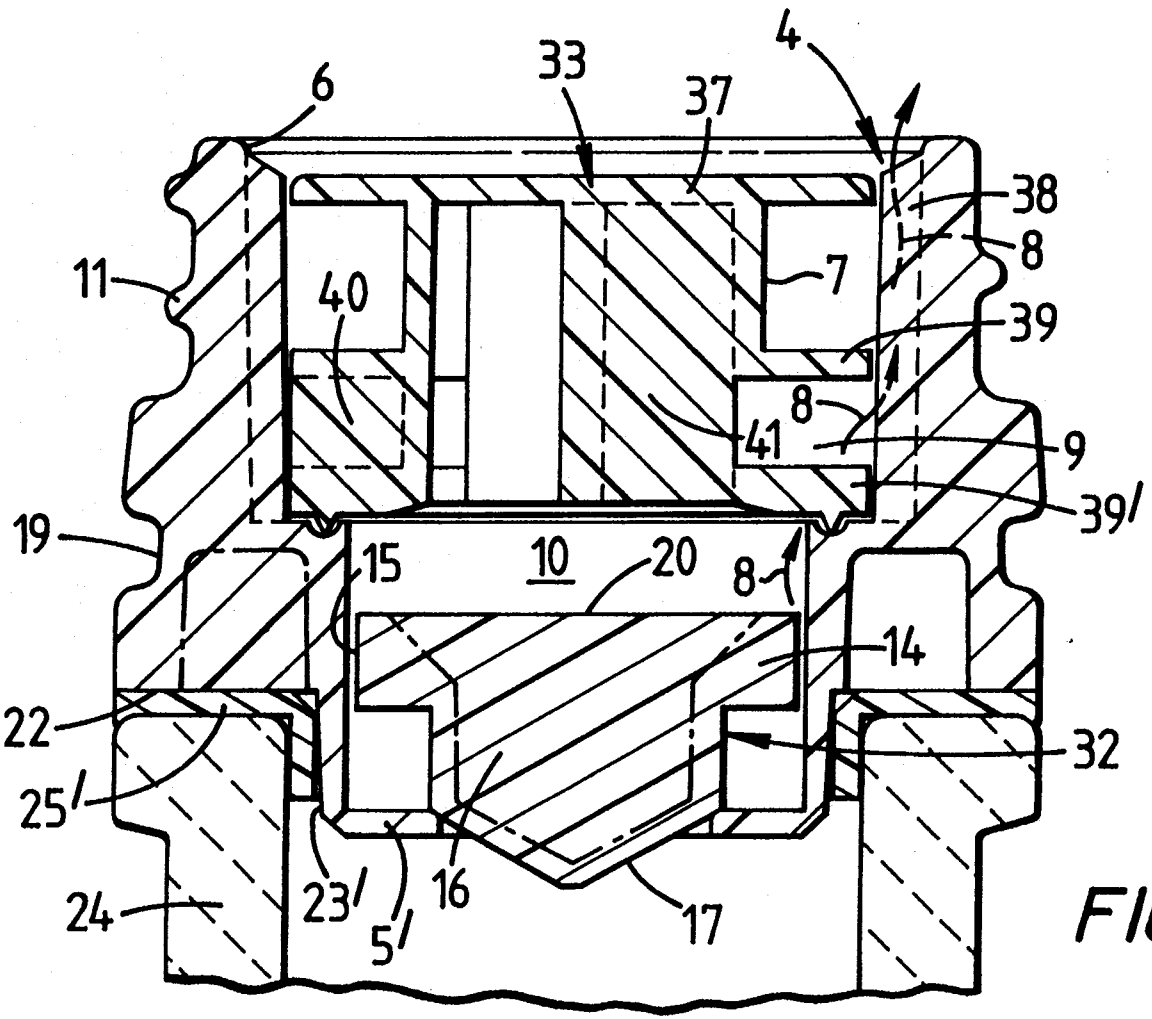
FIG. 6 shows a vertical cross-section through the assembled components of FIGS. 4 and 5, disposed on a bottleneck.

With reference to FIGS. 4, 5 and 6 of the accompanying drawings, the arrangements shown operate in a precisely analogous way to the arrangements shown in FIGS. 1 and 2 with the exception that the serpentine channel (8) formed by the device for the prevention of adulteration is more tortuous.

In the description which follows, like parts are designated by like numerals and operate in the same way or analogously. The description is therefore directed to points of difference. FIGS. 4 and 6 show a modified outer fitting body (11) provided on its interior bore (4) with a plurality of spaced, inwardly-directed splines (38). The modified valve member (32) is similar to the valve member (2) hereinbefore described with the exception that the fins (14) have a greater circumferential thickness.

The modified guard member (33) is somewhat different to the guard member (3) as before set forth. As will be appreciated from the exploded view of FIG. 4, upper and lower flanges (39 and $39^1$) are adapted to be a sliding fit past the splines (38) in the modified outer fitting body ($1^1$). Because the splines (38) retain the guard member (33) in an inwardly spaced position relative to the inner walls of the modified outer fitting body ($1^1$), liquid can flow from chamber (10) via aperture (9) and along the inner surface of the modified outer fitting body ($1^1$) adjacent the spline (38). By this means liquid flows toward the top guard flange (37) which substantially obturates the aperture of the bore (4) such that the path from the exterior into the valve body (32) is made even more difficult for an unauthorized insertion, because it is not possible to insert a pre-bent wire into the bore (4) which will negotiate the path to the valve body (32).

It will also be noted that the interior of the chamber (10) in this instance includes baffle members (41).

In use the arrangement of FIGS. 4 to 6 is assembled as shown in FIG. 6 and used analogously to FIG. 2. It will be noted that the passage (8) of FIG. 2 is, with reference to FIGS. 4 to 6, even more difficult to by-pass from the entry to the bore (4).

Figure 3:
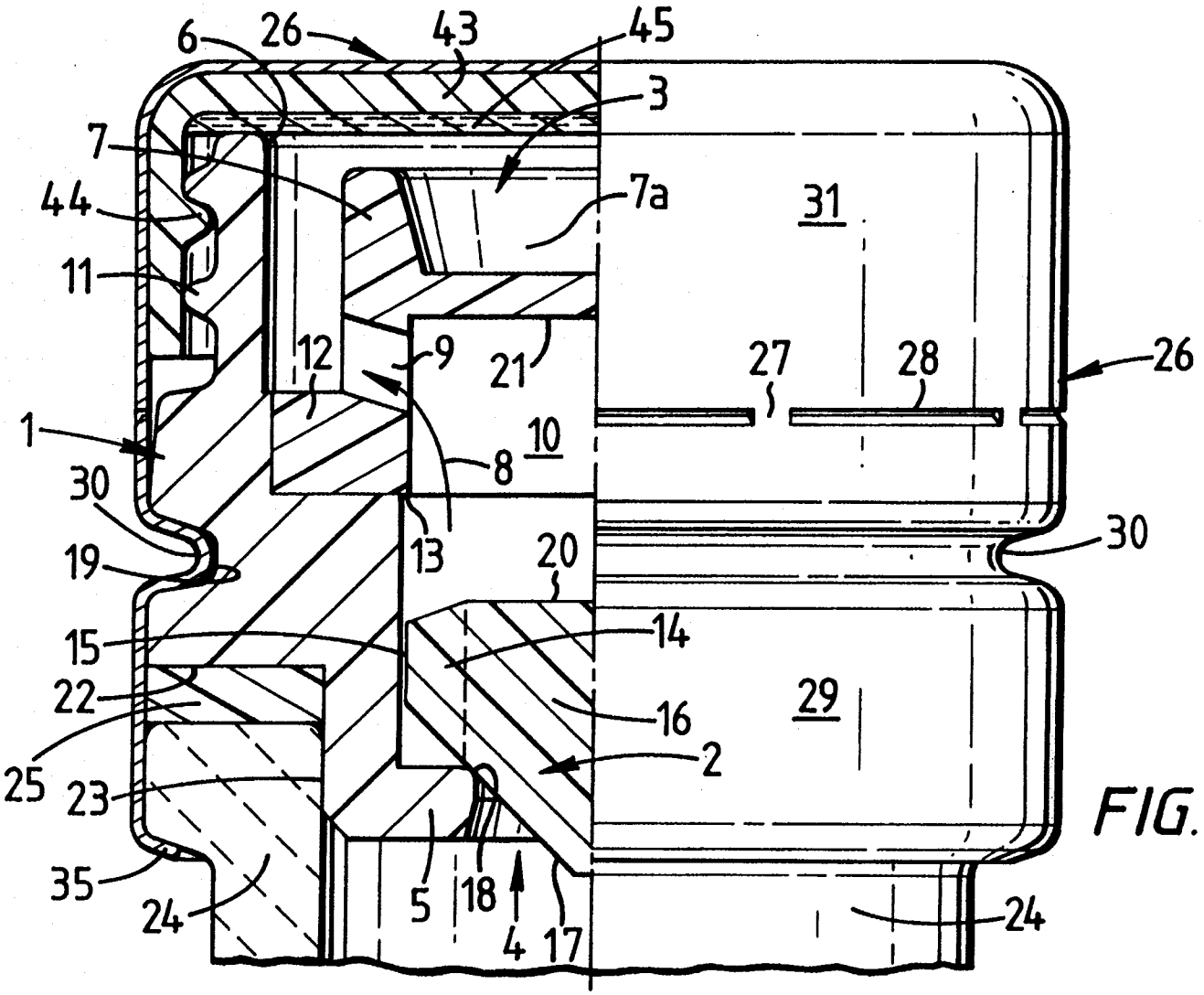
FIG. 3 shows a fitting of FIGS. 1 and 2 applied to the neck of a vodka bottle in vertical elevation and in part vertical cross-section.

Turning now to FIG. 3, the same elements of the arrangement of FIG. 2 are shown with the exception that the device of FIG. 2 is shown applied to a container neck (24). In order to apply the fitting of FIGS. 1 and 2 to a container neck (24), a gasket (25) of polyethylene is first disposed between the outer body flange portion (22) of the outer body and the top of the neck of the container (24). In FIG. 6 a gasket ($25^1$) of an annular flanged configuration is applied to the container neck (24). This spaces the exterior annular face ($23^1$) of the inlet end ($5^1$) of the lower portion of the outer body ($1^1$) for the container neck (24) and provides a better seal.

The description which follows alludes to the arrangement of FIGS. 1 to 3, but analogously is applicable to FIGS. 4 to 6.

Subsequently an outer metal shell (26) is disposed about the outer body (1). The outer metal shell (26) is in this instance formed of aluminium and is provided with a line of frangible bridges (27) disposed peripherally about the exterior thereof to define a peripheral slit line (28). The portion of the outer metal shell (26) above the slit line is referred to as the cap (31); the portion below the slit line is the security band portion (29). Disposed in the shell (26) is an annular plastics insert (43) which, in this instance, has been extended to cover the internal surface of the crown of the metal cap (31). The annular plastics insert formed of polypropylene is provided with an internal thread (44) for co-operation with threads (11) previously described. Internal liner (45) is disposed between the outlet end of the outer body of the fitting (1) and the periphery of the underside of the cap (31).

It will be appreciated that prior to the forming of the annular recess (30) and the inturned security lip (35), the metal cap may be screwed upon the outer body (1) of the fitting thereby to retain the same in a sealed condition. It is then only necessary to roll the inturned security lip (35) onto the corresponding shoulder of the bottle neck (24) and simultaneously form the rolled annular recess (30) to lock the fitting onto the container neck permanently while allowing cap (31) to be removed and replaced at will. By means of this arrangement it is possible to sell assemblies of the fitting and metal cap therefor for simple rolling in situ. By means of the arrangement in accordance with the present invention it has been found that it is very difficult, even for those experienced, to introduce adulterating liquids into the liquid in the container, with the added advantage that glugging is alleviated.

It is also the case that by use of the closures in accordance with the present invention the rolling step is made that much more simple. Accordingly, assembly after filling of the containers with vodka, for example, is quicker.

What is claimed is:

1. An anti-glug fitting for cooperation with the neck portion of a container for liquids, comprising (a) an outer body adapted to conform to the neck portion of the container and containing a shaped through bore extending from an inlet to an outlet;

(b) a guard member arranged within and partially obturating the outer body outlet; and (c) a valve body arranged within said bore and partially obturating said outer body inlet, said valve body having an outer periphery defining a plurality of spaced apertures communicating with said inlet, a portion of said through bore defined by the interior of said guard number comprising a chamber having a total volume exceeding the volume of said valve body apertures, whereby the volume flow of liquid from the container past said valve body is defined by the total area of said apertures.

2. A fitting as defined in claim 1, wherein said valve body is movable within said through bore between a closed position obturating said inlet and an open position which allows flow of liquid from the container.

3. A fitting as defined in claim 1, wherein said valve body includes a plurality of spaced fins which define said apertures.

4. A fitting as defined in claim 3, wherein said fins have a tapered bottom portion.

5. A fitting as defined in claim 4, wherein said fins extend radially from an axis of said valve member.

6. A fitting as defined in claim 4, wherein said fins extend helically from an axis of said valve member.

7. A fitting as defined in claim 2, wherein said outer body includes a valve seat adjacent to said inlet and said valve body includes a frusto-conical portion which engages said seat when said valve body is in the closed position.

8. A fitting as defined in claim 2, wherein said guard member contains a plurality of radial openings affording communication between said chamber and said outlet, said chamber having a depth when said valve member is in the open position which is greater than a height of said radial openings.

9. A fitting as defined in claim 1, wherein said outlet has a first radial component and a second component generally perpendicular to said first component.

10. A fitting as defined in claim 1, wherein said valve body defines an outlet passage for flow of liquid through said through bore to said outlet, said passage including at least three changes of direction each generally on the order of 90°.

11. An anti-glug fitting for cooperation with the neck portion of a container for liquids, comprising (a) an outer body adapted to conform to the neck portion of the container and containing a shaped through bore extending from an inlet to an outlet;

(b) a guard member arranged within and partially obturating the outer body outlet; and (c) a valve body arranged within said through bore and partially obturating said outer body inlet, said valve body and said outer body cooperating to define a plurality of spaced apertures communicating with said inlet, a portion of said through bore defined by the interior of said guard member comprising a chamber having a total volume exceeding the volume of said apertures, whereby the volume flow of liquid from the container past said valve body is defined by the total area of said apertures.

* * * * *